US007255652B2

(12) United States Patent
Braly et al.

(10) Patent No.: US 7,255,652 B2
(45) **Date of Patent: *Aug. 14, 2007**

(54) LIGHTWEIGHT, DURABLE GOLF CLUB SHAFTS

(75) Inventors: W Kim Braly, Scottsdale, AZ (US); William G. Sprague, Torrington, CT (US)

(73) Assignee: True Temper Sports, Inc., Memphis, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/345,872

(22) Filed: Feb. 1, 2006

(65) Prior Publication Data

US 2006/0128495 A1 Jun. 15, 2006

Related U.S. Application Data

(62) Division of application No. 10/342,857, filed on Jan. 15, 2003, now abandoned.

(51) Int. Cl.
*A63B 53/12* (2006.01)

(52) U.S. Cl. ..... 473/323

(58) Field of Classification Search ..... 473/323
See application file for complete search history.

(56) References Cited

U.S. PATENT DOCUMENTS

| | | | | |
|---|---|---|---|---|
| 1,740,144 | A | | 12/1929 | Barrett |
| 1,884,589 | A | | 10/1932 | Davies |
| 2,344,779 | A | | 3/1944 | Kolderman et al. |
| 3,564,886 | A | | 2/1971 | Nakamura |
| 3,871,649 | A | | 3/1975 | Kilshaw |
| 4,169,595 | A | | 10/1979 | Kaugars |
| 4,288,075 | A | | 9/1981 | Kaugars et al. |
| 4,431,187 | A | * | 2/1984 | Rumble et al. ..... 473/323 |
| 5,022,652 | A | | 6/1991 | Fenton |
| RE33,735 | E | | 11/1991 | Rumble |
| 5,163,681 | A | * | 11/1992 | Hodgetts ..... 473/289 |
| 5,203,190 | A | | 4/1993 | Kramer et al. |
| 5,324,032 | A | | 6/1994 | Munami |
| 5,481,892 | A | | 1/1996 | Roper et al. |
| 5,524,466 | A | | 6/1996 | Coe |
| 5,620,380 | A | | 4/1997 | Tennent et al. |
| 5,857,921 | A | | 1/1999 | Braly et al. |
| D407,456 | S | | 3/1999 | De La Cruz et al. |
| 6,014,879 | A | | 1/2000 | Jackel et al. |
| 6,044,678 | A | | 4/2000 | Olszewski |
| 6,071,460 | A | | 6/2000 | Renaudin et al. |
| 6,216,509 | B1 | | 4/2001 | Lotspaih et al. |
| 6,273,829 | B1 | | 8/2001 | Carlson et al. |
| 2001/0014626 | A1 | | 8/2001 | Takiguchi et al. |
| 2002/0123392 | A1 | | 9/2002 | Yamada |
| 2003/0144073 | A1 | | 7/2003 | Blough |
| 2004/0092330 | A1 | | 5/2004 | Meyer et al. |

* cited by examiner

*Primary Examiner*—Stephen Blau
(74) *Attorney, Agent, or Firm*—Harness, Dickey & Pierce, P.L.C.

(57) ABSTRACT

An ultra lightweight golf club shaft which includes a butt section, a tip section, and a tapered section interconnecting the same. The tapered section can be a constant taper, or include a plurality of step portions interconnected by frustoconical transition areas. The shafts are extremely durable and allow a faster club head speed and a better feel than with the previous prior art shafts.

7 Claims, 1 Drawing Sheet

LIGHTWEIGHT, DURABLE GOLF CLUB SHAFTS

This is a division of application Ser. No. 10/342,857, filed on Jan. 15, 2003, of W. Kim Braly et al. for LIGHTWEIGHT, DURABLE GOLF CLUB SHAFTS now abandoned.

FIELD OF THE INVENTION

The present invention relates to an ultra lightweight golf club shaft having excellent strength which includes a tapered section having a particular tapered design from a larger diameter to a smaller diameter. The shafts can either have a tapered section with a substantially constant reduction in diameter or a low angle stepdown design. More importantly, as disclosed herein, the configuration of the shafts makes them extremely durable even though they are much lighter in weight than conventional shafts. The lightweight shafts allow for a faster club head speed and thus can produce longer distance shots as well as better feel.

BACKGROUND OF THE INVENTION

Typical prior art golf club shafts are designed having a butt section, and a tip section interconnected by a tapered section, wherein the butt section has a larger outer diameter than the tip section. The butt and tip sections typically have a constant outer diameters throughout their length. The outer diameter is reduced between the butt section and the tip section by utilizing a step forming operation whereby a series of relatively steep step portions are introduced into the shaft tapered section along the length thereof. The diameter of the step portions become progressively smaller toward the tip end. Adjacent step portions are separated by narrow transitional areas having a stepdown angle of 8° when measured with respect to the longitudinal axis running through the shaft from the tip section to the butt section. However, it has been found that the use of the steep transitional portion angles result in several undesirable disadvantages, including creating a stress concentration area along the circumferential axis of the shaft at the transition area and a discontinuous stiffness along the length of the shaft. Accordingly, the shaft must be made relatively thick and heavy to overcome the stress concentration.

It is generally known that an ideal golf club shaft should be of a minimal weight while concurrently being of a sufficient durability and stiffness to effectively allow all of the kinetic energy developed by the golfer to be transmitted to the golf ball. Heretofore, steel, or other metal, or non-graphite golf club shafts have been produced that are 95 grams or greater at traditional lengths of 40 and 41 inches or on average 2.38 and 2.32 grams/inch, respectively. In the prior art weight range, the average golfer cannot generate enough club head speed to produce much shaft flexing during the swing. Consequently, the average golfer cannot develop a proper feel for his clubs.

SUMMARY OF THE INVENTION

The present invention is a lightweight golf club shaft or set of shafts, including a tapered section having a plurality of constant diameter steps interconnected by transition areas of a frustoconical shape on the outer portion thereof. Alternatively, the shafts can have a substantially constant taper rate in the outer diameter of tapered section. The transition areas of the tapered section have a length of at least 0.150 inches and reduce the diameter of between the constant diameter steps at a more gradual rate than conventional shafts. Advantageously, the shafts of the present invention are less than 95 grams in weight at 40 or 41 inches and generally an average weight of less than about 2.31 or about 2.25 grams/inch. The shafts can be flexed by the average golfer thus giving better feel and higher club head speed.

BRIEF DESCRIPTION OF THE DRAWINGS

The invention will be better understood and other features and advantages will become apparent by reading the detailed description of the invention, taken together with the drawings, wherein.

DETAILED DESCRIPTION OF THE INVENTION

The golf club shafts or shaft blanks of the present invention are formed from tubes of metal or a metal matrix composite. When utilized herein, tube generally refers to a hollow cylinder or pipe having a constant outer diameter. The inner diameter, and thus the transverse cross sectional thickness throughout the length of the tube, can be constant or vary in one or more areas. That is, the inner diameter and thus the wall thickness, can be varied throughout the length of the tube, and can even contain "cycles" or repeating patterns such as but not limited to sinusoidal cycles.

The tube is generally considered a shaft after a process modifies, i.e. increases or decreases, at least a portion of the outer diameter so the same is no longer constant. The shaft is still a "tube" after being formed, albeit a specialized tubular blank having a special use. In the preferred embodiment, the shaft is manufactured from metal such as steel, titanium, aluminum, or alloys thereof. The shafts are preferably formed from 4140 m alloy steel available from manufacturers such as Worthington Steel of Pennsylvania. The shaft can also be a metal matrix composite as known in the art, wherein a matrix metal, such as but not limited to aluminum, surrounds or envelops fibers such as silicon carbide whiskers.

Figure 1:
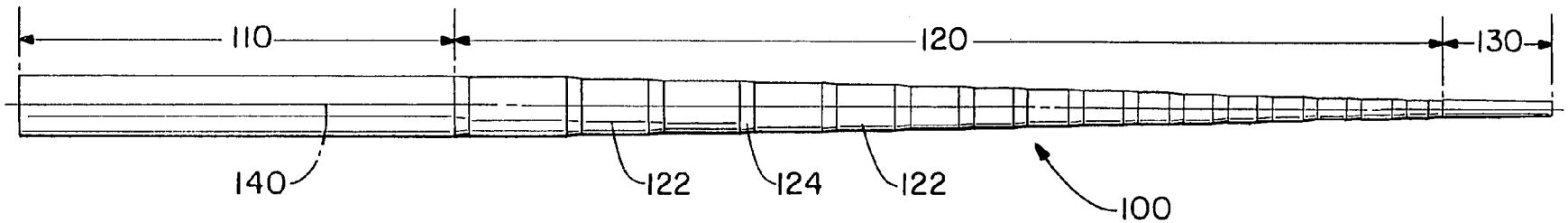
FIG. 1 is a side elevational view of a golf club shaft according to the present invention wherein the tapered section has a plurality of constant diameter steps interconnected by tapered transition areas.

Making reference now to the drawings, wherein like numerals indicate like or corresponding parts throughout the several figures, a golf club shaft prepared according to the present invention is shown in FIG. 1, and is generally designated 100. The shaft 100 includes a butt or grip section 110, a tip section 130, and a tapered section 120 therebetween. As is clear from the drawings, the butt, tip, and interconnecting tapered sections have a common, central longitudinal axis 140 extending therethrough.

As shown in FIG. 1, the butt section 110 has a constant outer diameter along its length. The outer diameter of the butt section ranges generally from about 0.550 to about 0.625 inches, desirably from about 0.560 to about 0.615 inches, and preferably from about 0.600 to about 0.610 inches. Alternatively, the butt section can be tapered, and have a reduction in outer diameter of less than about 0.010 inches per linear inch of the butt section, along the longitudinal axis of the shaft. The length of the butt section generally ranges from about 4 to about 16 inches, and preferably from about 8 to about 14 inches depending on the shaft stiffness desired. Each shaft in a set of clubs can have butt sections of equal or different lengths.

Figure 2:
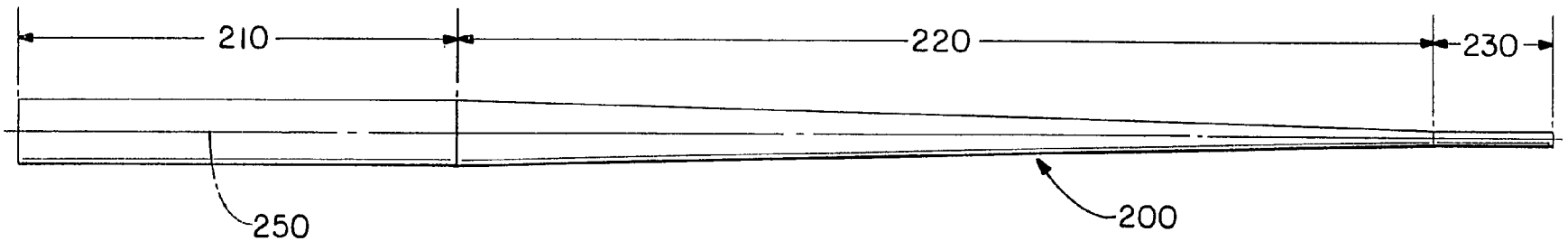
FIG. 2 is a side elevational view of a golf club shaft having a tapered section which tapers at a substantially constant rate.

Tip section 130 as shown in FIG. 1 is illustrated having a taper. It is also to be understood that the tip section can have a constant outer diameter throughout the length thereof, as shown in FIG. 2 with tip section 230. The outer diameter of a tapered tip section decreases from a location where it connects to the tapered section 120 to the distal end thereof which reduces the outer diameter of the tip section in a range generally from about 0.001 to about 0.020 inch per linear inch of the tip section, desirably from about 0.0050 to about 0.0100 inch per linear inch of the tip section, and preferably is about 0.0075 inch per linear inch of the tip section. The outer diameter of the tip section is greater than 0.310 or about 0.320 inch at a hosel end and for a wood is about 0.335 to about 0.350 inch, and about 0.355 to about 0.370 inch for a shaft used to make an iron. The length of the tip section of a shaft of the present invention is generally from about 2 to about 14 inches, desirably from about 2 to about 12 inches, and preferably from about 3 to about 10 inches. Each shaft in a set of shafts can have tip sections which are equal or different in length as measured along the longitudinal axis of the shaft.

The tapered portion 120 of shaft 100 of FIG. 1 includes a plurality of steps 122 interconnected by low angle tapered transition areas 124. In a preferred embodiment, each step portion 122 is cylindrical in shape, and has a constant or substantially constant outer diameter along its length. The outer diameter of each step portion is greater than the previous step portion when measured from the tip section to the butt section. Accordingly, the outer diameter of the shaft is increased from the tip section 130 to the butt section 110 in the tapered section 120. The length of each step portion may individually vary and range generally from about 0.25 or about 0.50 inches to about 3.0 inches. There are generally from about 10 to about 22 step portions 122 in the tapered section 120 of a shaft, with about 15 to about 18 step portions being preferred. The difference in outer diameters between adjacent step portions can range generally from about 0.005 to about 0.020 inch, and preferably from about 0.010 to about 0.015 inch.

As stated above, a plurality of transition areas 124 are present in the tapered section 120 which interconnect each step portion as well as the tip portion 130 and the butt portion 110 to the tapered section. In order to provide strength to the ultra lightweight shaft 100 of the present invention, the transition areas 124 have a length parallel to the longitudinal axis of the shaft 150 of at least about 0.100 inch and are preferably from about 0.15 to about 0.20 or about 0.35 inch. The stated length provides a substantially smooth, non-abrupt transition between the step portions 122 of the shaft 100 while providing strength to the shaft. The shape of the transition areas 120 are frustoconical in nature and taper from a larger outer diameter closest to the butt portion to a smaller diameter nearest the tip portion along the length thereof. There are generally about 11 to about 23 transition areas present on shafts of the present invention. The use of the longer transitional areas results in improved characteristics for the shaft, as opposed to the use of abrupt transitions between adjacent step portions of a conventional shaft typically utilized in the industry. The tapered section of shafts of the present invention has a length generally from about 15 to about 25, and preferably from about 18 to about 21 inches.

In order to provide the lightweight shafts of the present invention with strength and durability, the lightweight shaft 100 is provided with a low angle stepdown transition area 124 in the tapered section. The low angle stepdown provides for a gradual elongated change in shaft diameter and avoids sharp or steep angle changes. The low angle stepdown is present in substantially all and preferably all transition areas to impart strength to the shaft 100. The transition area angle, when measured from a first end to a second end where the transition area 124 interconnects two step portions 122, with respect to the longitudinal axis of the shaft 140 ranges generally from about 0.50 to about 5 degrees, desirably from about 0.75 to about 3 or about 4 degrees, preferably from about 1 to about 2 degrees, and most preferably is about 1.5 degrees. For example, a first shaft with a transition area having a taper angle of 1.5 degrees would reduce a step portion having a diameter from 0.372 to a second step portion having a diameter of 0.360, with the transition area having a length of 0.229 inch; and a second shaft with a first step portion would be reduced from a diameter of 0.372 inch to a second step portion having a diameter of 0.364 inch, with the transition area having a length of 0.153 inch. As can be seen in the examples hereinbelow, the characteristics of the transition areas of the lightweight shafts of the present invention impart excellent strength and durability characteristics to the lightweight shafts.

In a further embodiment of the lightweight shafts of the present invention, a shaft is formed having a tapered section 220 with a substantially constant reduction in outer diameter from the butt section to the tip section, as shown in FIG. 2. The shaft 200, has a butt section 210 and a tip section 230, interconnected by a tapered section 220. The taper rate for the tapered section 220 of shaft 200 is generally from about 0.0070 to about 0.0200 inch, and preferably from about 0.0090 to about 0.0150 inch per linear inch of tapered section length. The characteristics of the constant taper rate taper section 200 are generally otherwise the same for the shaft as disclosed above. As is clear from FIG. 2, the butt section 210, tapered section 220, and tip section 230 have a common central longitudinal axis 250.

It has been found that both embodiments of the golf club shafts as described hereinabove, i.e. a constant taper shaft or a stepdown tapered section shaft with an extended length low angle transition area can be produced as lightweight shafts and yet offer sufficient strength and stiffness characteristics.

The blank shafts of the present invention can be formed utilizing tube mandrel drawing or swaging techniques. During the process of forming the blank shaft, the tubular stock is generally drawn over a plug mandrel, or series of plug mandrels to predetermined thickness to produce the lightweight shafts of the present invention.

While manufactured tubes can be utilized, it is often desirable to begin the shaft formation process utilizing a planar piece or strip of metal. While thickness of the planar piece is not critical, the metal piece preferably has a constant thickness with suitable ranges being generally from about 0.030 to about 0.090 inch, and preferably from about 0.045 to about 0.055 inch thick. The planar piece is roll formed and welded by induction or resistance methods, well known to those of ordinary skill in the art, into a tube. Alternatively, the shaft formation process can be started by utilizing a seamless tube which has been formed by an extrusion process as known to those of ordinary skill in the art. The length of the tube at this point of the operation is not critical.

The tube is optionally annealed to soften or further prepare the material for subsequent forming. As known to those of ordinary skill in the art, the temperatures, times and types of atmospheres, i.e., air or inert environment, can vary depending on the metal or metal matrix composite utilized.

The tube is drawn in at least one and preferably at least four mandrel operations utilizing drawing practices known to those of ordinary skill in the art. The final drawing process forms the blank length and various other dimensions of the shaft such as the variable wall sections, butt diameter, etc. If desired, the tube can also be annealed before, between, or after any of the drawing process steps. If desired, variable wall thicknesses can be introduced into the tube during any of the drawing steps. This can be accomplished by moving a tapered inner mandrel in relation to an outer forming die when the tube material is drawn therebetween. Depending on the shaft, design of the tapered section can be formed having a substantially constant taper rate increase or decrease, or can have stepped portions and low angle transition areas therein. As is stated hereinabove, the present invention tubes or shafts can be formed with any number or combinations of variable wall thicknesses. Wall thickness is generally predicated upon maintaining a low shaft weight while still imparting the necessary strength and stiffness to the golf club shafts.

As is known in the art, stepped shafts are generally formed by holding the butt end of the shaft rigidly, and pushing the opposite end of the tube, which will become the tip section of the shaft, axially through one or more cylindrical dies, the inside diameter of which are less than the butt end diameter. The tube is pushed sufficiently far through each die such that the shaft obtains the appropriate diameter of each point along its length.

After the shaft has been formed into the desired dimensions, additional processing steps to impart characteristics such as strength and cosmetic appearance to the shaft can be performed, and include but are not limited to, cutting the tip and butt sections to predetermined lengths, heat treating, polishing, plating, etc.

In a preferred embodiment, a lightweight low angle stepdown tapered section shaft is produced, as in FIG. 1. The stepdown shaft has a constant diameter butt section of about 0.600 inch that is about 9 inches in length, and a constant diameter tip section of about 0.370 inch and about 12.5 inches in length. The stepdown tapered section has about an 18.5 inch length and includes seventeen transition areas and sixteen step sections. The transition areas have an angle of about 1.5 degrees with respect to the central longitudinal axis. Starting from the end of the butt section, the preferred shaft has five step sections with diameters which are reduced 0.010 inch in adjacent sections. The next eleven step sections have adjacent diameters which are 0.015 apart. The shaft was produced as described above and had a finished weight of 94.5 grams at 40 inches or an average weight of 2.76 grams per inch.

Golf club shafts are generally produced either for irons or woods having lengths of about 32 to about 41 inches for irons and about 41 to about 47 inches in length for woods. The iron or wood shafts are cut either from the tip section and butt section; both for variable weight shafts; or cut in the butt section or tip section only for constant weight shafts, in order to produce shafts for shorter irons, woods, wedges, or putters. Thus, a set of lightweight shafts, i.e., two or more shafts, of the invention can have either variable or constant weight. A set of golf club shafts for irons are generally cut at about 0.5 inch increments in the tip section or butt section, or a combination thereof, to produce a set therefrom. Obviously, the shortest variable weight shaft in the set will have a lighter weight than the longest shaft, usually for the longer irons or driver.

The lightweight shafts of the present invention are classified by having an average weight per linear length. The lightweight golf club shafts of the present invention have a weight to length ratio of less than 2.38 grams per inch and preferably less than about 2.30 or about 2.25 grams per inch, and range generally from about 2.10 to about 2.35, and preferably from about 2.20 to about 2.25 grams per inch. The lightweight shafts of the present invention are generally less than 95 grams, desirably about 92 grams to about 94.5 grams, and preferably about 92.5 or about 93 to about 94 grams at 40 or 41 inches in length.

EXAMPLES

In order to show the strength and durability characteristics of the lightweight shafts of the present invention, a comparative test was performed. A lightweight shaft having a constant taper rate taper section of the present invention was produced. The constant taper rate shaft had a weight of 94.7 grams at a length of 40 inches. A lightweight low angle transition area stepdown shaft was produced according to the method set forth hereinabove. The shaft had a weight of 94.5 grams at 50 inches. The transition areas had an angle of 1.5 degrees when measured compared to the central longitudinal axis. A conventional stepdown shaft having relatively steep angles in the transition area of 8 degrees was also formed. The shaft had a weight of 95 grams at 40 inches.

All three shafts were cut to a length of 38 inches which is standard for a five iron club. The same five iron head was fitted to each shaft for testing, the results of which are listed in Table I. The head had a loft of 28 degrees. A Bird Air Cannon, which is well known to those of ordinary skill in the art, was utilized to fire a ball at 100 miles per hour ball speed at the stationary club in the testing apparatus. A low toe hit location was utilized. The following table illustrates the number of hits and location of failure for the various clubs described.

TABLE I

| | Tapered section | | |
|---|---|---|---|
| | Lightweight Constant Taper | Lightweight Low Angle Stepdown Taper | Conventional Stepdown |
| Weight (g) | 94.7 | 94.5 | 95 |
| Length (in) | 40 | 40 | 40 |
| CPM (cycles per minute) | 220 | 218 | 218 |
| # impacts until failure | 52 | 46 | 35 |
| Location failed | Grip | Grip | Grip |

As can be seen from the above table, both lightweight shafts of the present invention faired considerably better than the conventional stepdown prior art shaft. The lightweight low angle stepdown withstood 11 more hits and thus lasted 31 percent longer than the conventional prior art shaft. Likewise, the lightweight constant taper rate tapered section shaft withstood 52 hits and lasted 48.6 percent longer than the conventional prior art stepdown shaft. As can be seen from the results, the lightweight shafts of the present invention unexpectedly exhibit increased strength and durability when compared to conventional prior art shafts which are similar but greater in weight.

In accordance with the patent statutes, the best mode and preferred embodiment have been set forth, the scope of the invention is not limited thereto, but rather by the scope of the attached claims.

What is claimed is:

1. A lightweight golf club shaft, said shaft comprising:

a tip section;

a tapered section connected to said tip section; and a butt section having a length of about 4 to about 16 inches connected to said tapered section, wherein said shaft is steel having a plating on an outer surface of said shaft, wherein said tapered section has a plurality of constant diameter step portions connected by transition areas having a taper angle of about 0.75 to about 3 degrees with respect to the longitudinal axis of the shaft, wherein said shaft has a weight of 92 to less than 95 grams when measured at 40 inches or 41 inches, and wherein said tip section has a length of about 2 to about 14 inches and a hosel end with an outer diameter greater than 0.310 inch.

2. The shaft according to claim 1, wherein said butt section has an outer diameter of about 0.550 to about 0.625 inch, and wherein said tip section outer diameter is about 0.320 to about 0.370 inch.

3. The shaft according to claim 2, wherein said shaft is about 92 grams to about 94.5 grams at 40 or 41 inches in length.

4. The shaft according to claim 1, wherein about 10 to about 22 step portions are present and about 11 to about 23 transition areas are present.

5. The shaft according to claim 4, wherein said shaft is about 92 grams to about 94.5 grams at 40 or 41 inches in length.

6. The shaft according to claim 5, wherein said transition areas have an angle of about 1 to about 2 degrees with respect to a longitudinal axis of the shaft.

7. A set of shafts according to claim 5.

* * * * *